US005137012A

United States Patent [19]

Crossman, Jr. et al.

[11] Patent Number: 5,137,012

[45] Date of Patent: Aug. 11, 1992

[54] PELLET BURNING STOVE

[75] Inventors: William W. Crossman, Jr.; Derik K. Andors, both of Randolph; Richard S. Blackburn, South Royalton; Allan S. Wilker, Brookfield; John H. Guest, Norwich, all of Vt.

[73] Assignee: Vermont Castings, Inc., Randolph, Vt.

[21] Appl. No.: 681,041

[22] Filed: Apr. 5, 1991

[51] Int. Cl.[5] ..... F24B 1/199

[52] U.S. Cl. ..... 126/501; 126/73; 126/77; 110/110; 110/286

[58] Field of Search ..... 126/110 R, 67, 73, 77, 126/92 R, 92 AC, 92 C, 68, 501; 110/286, 293, 110, 290, 109

[56] References Cited

U.S. PATENT DOCUMENTS

| | | | |
|---|---|---|---|
| 4,474,117 | 10/1984 | Marollaud | 110/290 |
| 4,522,311 | 6/1985 | Ikeda | 220/662 |
| 4,683,868 | 8/1987 | Ferguson et al. | 126/193 |
| 4,803,973 | 2/1989 | Harman | 126/77 |
| 4,858,536 | 8/1989 | Guest et al. | 110/166 |
| 5,018,455 | 5/1991 | Harman | 110/110 |

FOREIGN PATENT DOCUMENTS

| | | | |
|---|---|---|---|
| 1225541 | 2/1960 | France | 110/110 |
| 157417 | 9/1984 | Japan | 110/293 |

*Primary Examiner*—Carroll B. Dority
*Attorney, Agent, or Firm*—Wolf, Greenfield & Sacks

[57] ABSTRACT

A pellet burning stove includes a firebox defining a combustion chamber, a pellet burner located within the firebox, a feed system for moving combustible pellets to the pellet burner and an ash pan for receiving ashes from the pellet burner. The pellet burner includes a horizontal surface having an elongated combustion zone defined by a plurality of primary air openings in the burner surface, and a feed surface adjacent to the combustion zone. The feed system moves a thin layer of combustible pellets across the feed surface into the combustion zone. An air plenum surrounding the feed surface of the pellet burner supplies combustion air upwardly through the primary air opening and the layer of combustible pellets. The air plenum maintains the pellets relatively cool until they reach the combustion zone. Ashes drop off an edge of the burner surface into an ash pan. An artificial log set and a log support member fabricated of refractory fiber material define a secondary combustion cavity above the pellet burner. Secondary air is supplied through the air plenum of the pellet burner and from an air wash system that maintains a viewing window clean during operation. The feed system typically includes an auger and a pusher block which move pellets from a pellet bin to the pellet burner.

24 Claims, 9 Drawing Sheets

PELLET BURNING STOVE

FIELD OF THE INVENTION

This invention relates to solid fuel heating devices and, more particularly, to a pellet burning stove that is typically located in the living area of a home.

BACKGROUND OF THE INVENTION

Wood and coal burning stoves, also known as parlor stoves, for home heating are well known in the art. Recently, combustible pellets have come into use as a solid fuel. The combustible pellets are made from sawdust, shavings, wood and other plant material by an extrusion process. Individual pellets typically have a cylindrical form on the order one-quarter inch in diameter by one inch long. Although the pellets burn in a manner similar wood logs, the rate of combustion is faster, and systems for automatically feeding the pellets into a stove at a controlled rate are typically utilized.

Commercially available pellet burning stoves typically include a burn pot located within a firebox and a feed system for feeding pellets from a bin to the burn pot. The pellets are usually fed vertically into a relatively deep burn pot. Prior art pellet burning stoves have had various disadvantages, including a flame appearance that is not aesthetically pleasing, difficulties with ash removal and excessive dust and dirt within the stove.

It is a general object of the present invention to provide an improved pellet burning stove.

It is another object of the present invention to provide a pellet burning stove which simulates the appearance of burning wood logs.

It is yet another object of the present invention to provide a pellet burning stove having high heat output.

It is a further object of the present invention to provide a pellet burning stove having high combustion efficiency.

It is still another object of the present invention to provide a pellet burning stove wherein ashes are easily removed.

It is yet another object of the present invention to provide a pellet burning stove having a viewing window that remains clean over extended operating periods.

It is a further object of the present invention to provide a pellet burning stove having a pellet bin that is convenient and easy to use.

SUMMARY OF THE INVENTION

According to the present invention, these and other objects and advantages are achieved in a pellet burning stove comprising a firebox defining a combustion chamber, a pellet burner located within the firebox, the pellet burner comprising a horizontal burner surface having an elongated combustion zone defined by a plurality of primary air openings in the burner surface, and a feed surface adjacent to the combustion zone, feed means for moving a layer of combustible pellets across the feed surface into the combustion zone and for moving ashes from the combustion zone, means for supplying combustion air upwardly through the primary air openings and the layer of combustible pellets, and an ash pan for receiving ashes from the pellet burner.

Preferably, the primary openings in the burner surface are formed in one or more rows perpendicular to the direction of movement of the combustible pellets. In a preferred embodiment, the combustion zone is a linear strip into which a thin layer of combustible pellets passes and is burned. The ashes from the moving layer of combustible pellets are pushed to an edge of the burner surface and drop into the ash pan.

Preferably, the pellet burner further includes a combustion air plenum surrounding at least a portion of the feed surface and connected to the primary air openings. The combustion air plenum effectively insulates the pellets moving along the feed surface and prevents the pellets from becoming overheated before they reach the combustion zone. The combustion air plenum preferably includes a plurality of secondary air openings above the burner surface for supplying secondary air above the combustion zone.

The feed surface of the pellet burner is located between the combustion zone and the feed means and is preferably tapered from relatively narrow adjacent to the feed means to relatively wide adjacent to the combustion zone such that combustible pellets supplied by the feed means are distributed relatively uniformly across the elongated combustion zone. Preferably, the combustion zone and the feed surface of the pellet burner are generally flat and coplanar so that the combustible pellets are moved horizontally to the combustion zone.

The pellet burning stove in accordance with the invention preferably includes an artificial log set and a log support member for supporting the artificial log set. The artificial log set and the log support member are preferably fabricated of a low density refractory fiber material and define a secondary combustion cavity. The log support member includes a rear wall and side walls extending forwardly from the rear wall. The artificial log set simulates burning wood logs. The secondary combustion cavity receives combustion products from the burning of pellets and supports secondary combustion. The refractory fiber material of the artificial log set and the log support member reradiate heat into the secondary combustion cavity and maintain a high temperature therein.

The feed means preferably comprises a rotating auger for supplying pellets to the feed surface, a pellet bin for containing a supply of combustible pellets and a pusher block for moving pellets from the bin to the auger. In a preferred embodiment, the pellet bin includes a transparent cover, and the cover is hinged to the pellet bin. A gas shock absorber can be connected to the hinged cover for controlling opening and closing of the cover.

According to another feature of the pellet burning stove, the firebox preferably includes a transparent window and means for supplying an air curtain downwardly across an inner surface of the transparent window. The air curtain assists in maintaining the inner surface of the window clean. The air curtain, after passing over the transparent window, provides secondary combustion air to the pellet burner.

The ash pan is preferably mounted to a hinged ash pan door. The ash pan door is movable between a closed ash collection position and an open ash removal position. In the open position, the ash pan can be lifted from the ash pan door. The burner surface of the pellet burner includes an edge located above the ash pan. The feed means pushes ashes over the edge of the burner surface so that they drop into the ash pan.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1:
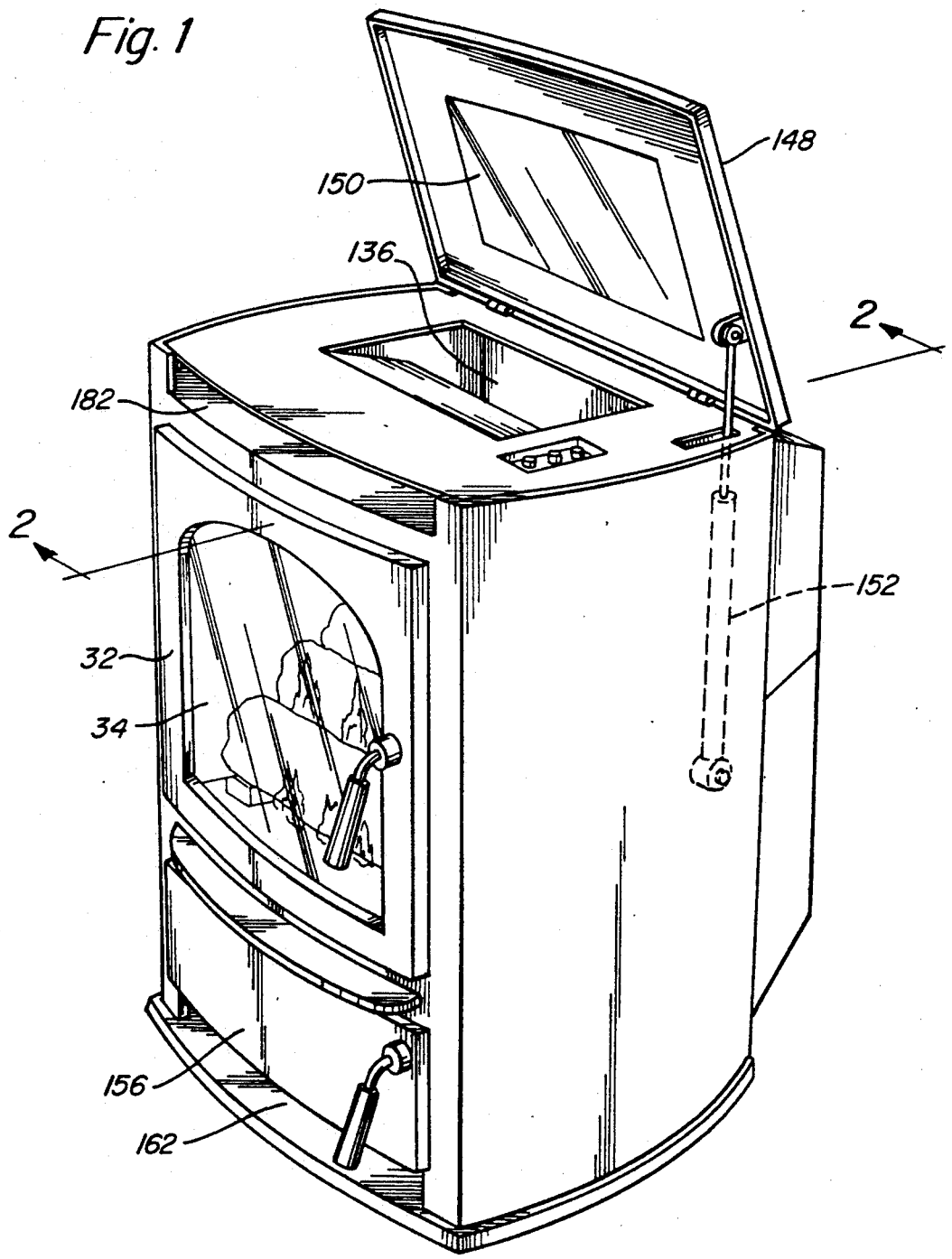
FIG. 1 is a perspective view of the pellet burning stove with the pellet bin cover in an open position.

A pellet burning stove in accordance with a preferred embodiment of the present invention is shown in FIGS. 1-8. Major components of the pellet burning stove include a firebox 10 defining a combustion chamber 12, a pellet burner 14, a feed system 16 for supplying pellets to the pellet burner 14, an ash pan 18, an air supply system for supplying combustion air and for removing exhaust gas from the combustion chamber, and a system for circulating room air over the firebox 10 and a heat exchanger. The firebox 10 is defined by a top wall 24, a rear wall 26, side walls 28 and 30, a main door 32 having a transparent window 34 and an ash pan enclosure 36.

The pellet burner 14 is characterized by a narrow, elongated combustion zone 40 on a horizontal burner plate 42. The pellet burner is best shown in FIGS. 2, 4, 5 and 8. A thin layer of combustible pellets 44 is moved horizontally by feed system 16 across a surface of burner plate 42. The burner plate 42 includes a feed surface 46, the combustion zone 40 and an ash removal surface 48. The combustion zone 40 is defined by a plurality of primary air openings 50 in the burner plate 42. Preferably, primary air openings are formed as one or more rows of openings 50 perpendicular to the direction of pellet movement on burner plate 42. The openings 50 supply primary combustion air upwardly through the layer of pellets 44 that is moving over them. The openings 50 must be of a size to provide sufficient primary air for combustion but must not be so large as to allow pellets or pellet fragments to drop through openings 50. Preferably, openings 50 are in the range of about 0.150 inch to 0.200 inch in diameter. A combustion air plenum 52 supplies air through openings 50 as described below.

The feed surface 46 is located between the combustion zone 40 and the feed system 16. As described below, the feed system typically employs an auger to deliver pellets to the pellet burner 14. The feed surface 46 of burner plate 42 is preferably tapered in width from relatively narrow at the end connected to the feed system to relatively wide adjacent to the combustion zone 40. The tapered feed surface 46 allows the pellets to spread out into a thin layer of generally uniform thickness as they are pushed toward the combustion zone 40. As the pellets reach the combustion zone 40 above primary air openings 50, they burn vigorously and are turned into ashes. The ashes are pushed by the advancing layer of pellets across ash removal surface 48 to an edge 54 of burner plate 42. When the ashes reach edge 54, they drop into the ash pan 18.

Another important feature of the pellet burner 14 is the combustion air plenum 52 which includes a bottom plenum section 60 defining an air passage below burner plate 42, a top plenum section 62 defining an air passage spaced above feed surface 46 and the layer of pellets moving thereon, and side plenum sections 64 and 66 on opposites sides of feed surface 46. The plenum sections 60, 62, 64 and 66 are all interconnected and receive air through an air inlet to the rear of pellet burner 14 as described below. The air plenum 52 has a coaxial configuration relative to feed surface 46 and surrounds a substantial portion of the feed surface 46. The air plenum 52 has two important functions. It supplies primary combustion air through primary air openings 50 to the combustion zone 40 and supplies secondary combustion air through secondary air openings 68. The secondary air openings 68 are formed in top plenum section 62 above burner plate 42. The air plenum 52 also maintains the pellets which are moving across feed surface 46 relatively cool by insulating the pellets from the high temperature environment in the combustion chamber 12. It is desirable to maintain the pellets at a relatively low temperature until they reach combustion zone 40 in order to prevent premature ignition of the pellets and a progressive advancement of the combustion region toward the pellet bin. In addition when the pellets are raised to a high temperature, they tend exude a sticky substance which can cause them to stick together. When this occurs, the pellets are difficult to control.

Figure 4:
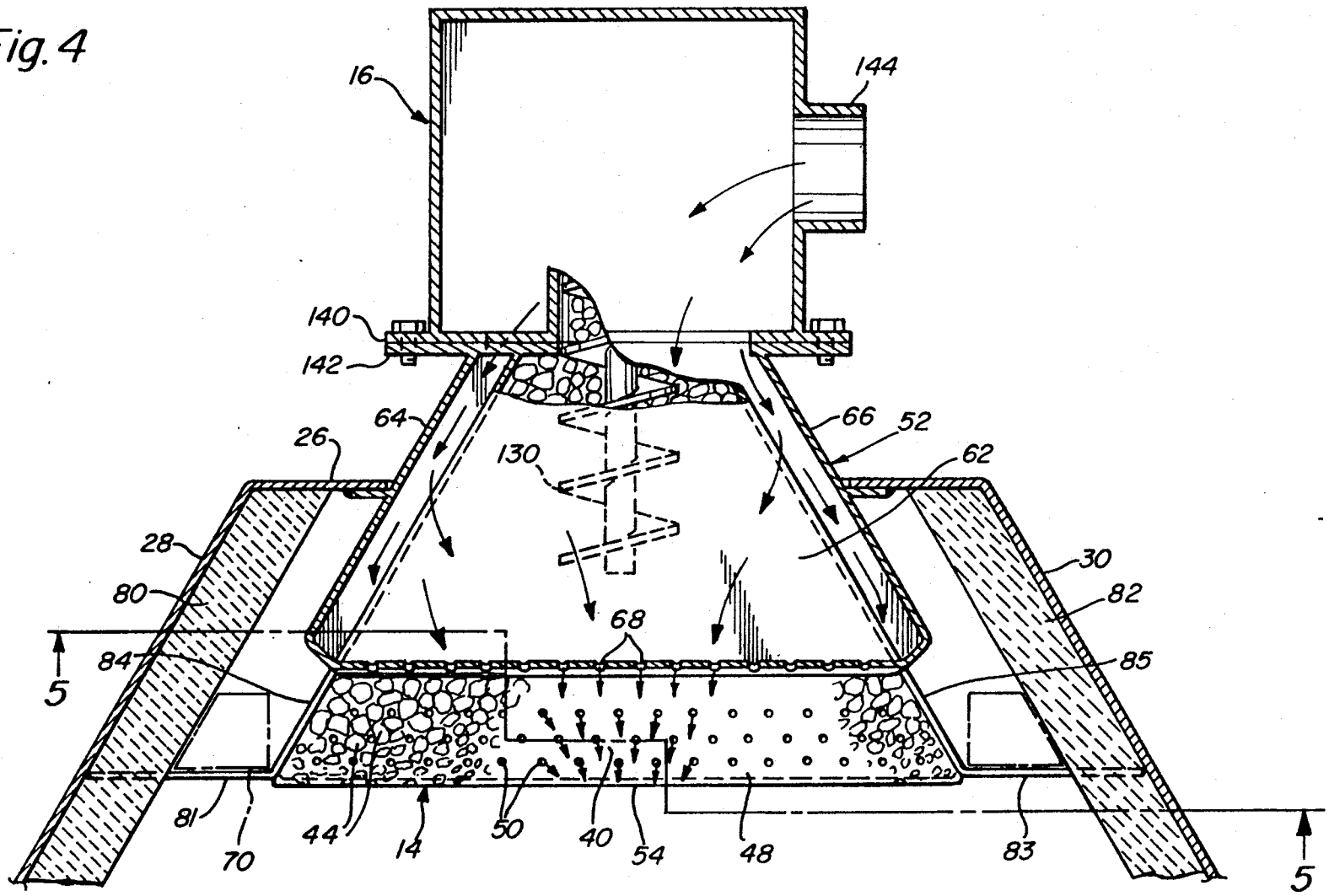
FIG. 4 is a cross-sectional top view of the pellet burning stove taken along the line 4—4 of FIG. 2.
Figure 5:
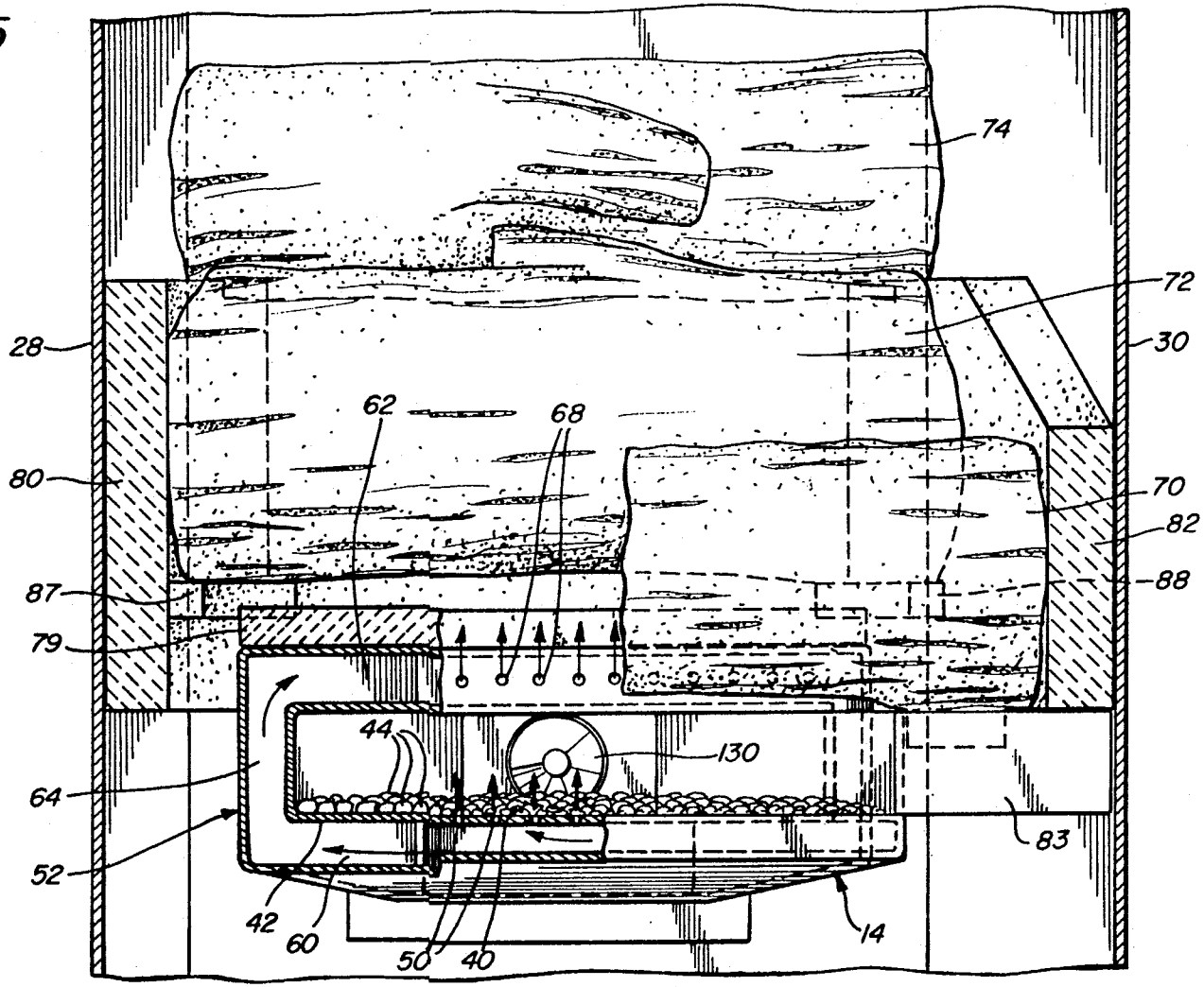
FIG. 5 is a cross sectional front view of the pellet burner taken along the line 5—5 of FIG. 4.
Figure 6:
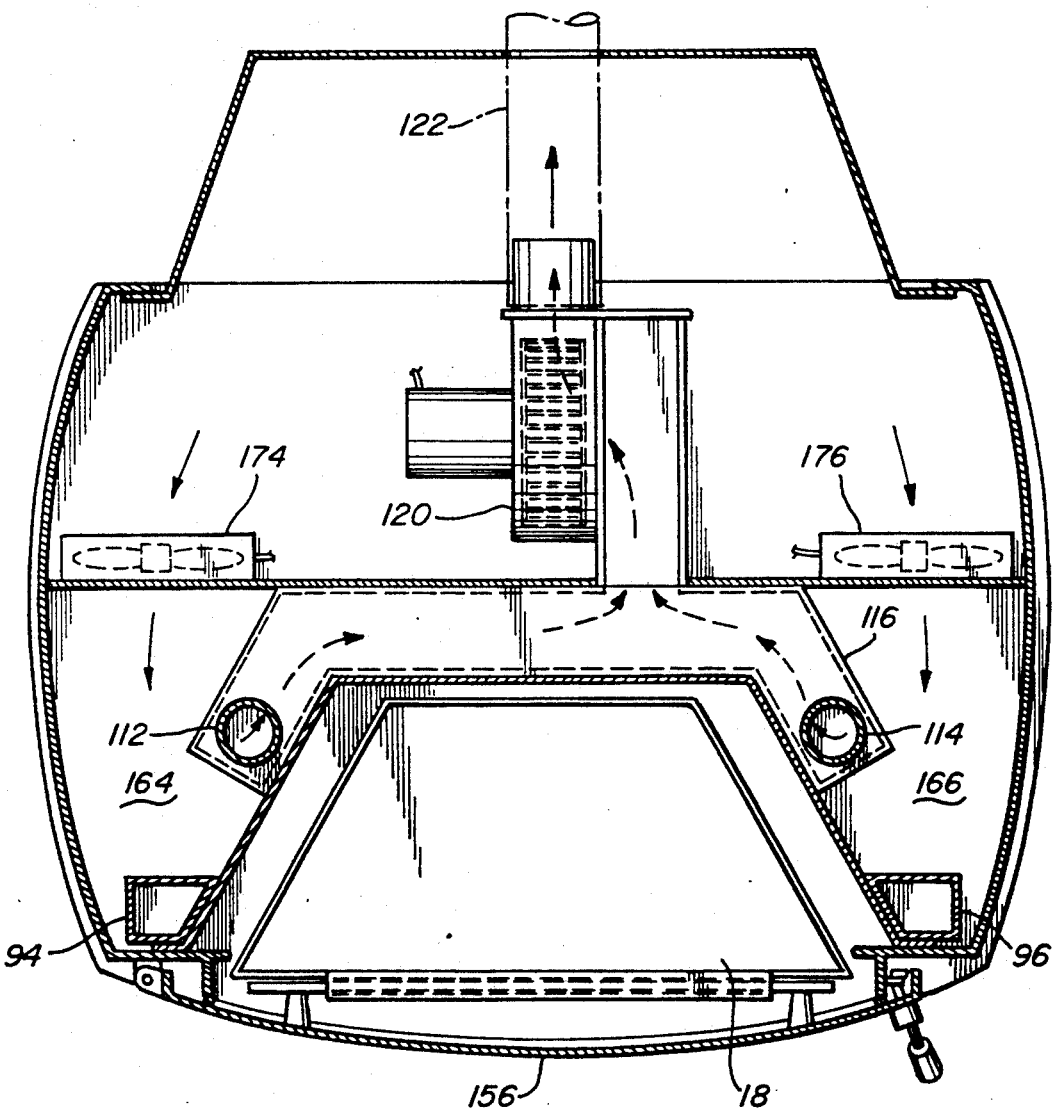
FIG. 6 is a cross sectional top view of the pellet burning stove taken along the line 6—6 of FIG. 2.

In operation, a thin layer of combustible pellets is pushed across feed surface 46 by the feed system 16. The pellets are maintained at a relatively cool temperature by the air plenum 52 which completely surrounds a major portion of feed surface 46. The pellets are ignited when they reach the rows of primary air openings 50. Since the primary combustion air is directed upwardly through the layer of pellets, a relatively stable line of flame is produced in a region corresponding to the primary air openings 50. The pellets are turned to ashes in the combustion zone 40, and the ashes drop from edge 54 into ash pan 18. The tapered feed surface 46 permits spreading of the pellets into a relatively wide combustion zone 40. The movement of pellets from feed system 16 to combustion zone 40 is horizontal or inclined slightly downwardly from horizontal toward the front of the stove to enhance feeding of pellets and removal of ashes. Although the rows of primary air openings 50 are shown in FIG. 4 as straight lines, it will be understood that the combustion zone can be curved or otherwise shaped as desired. The pellet burner 14 is preferably fabricated of cast iron or stainless steel.

Figure 7:
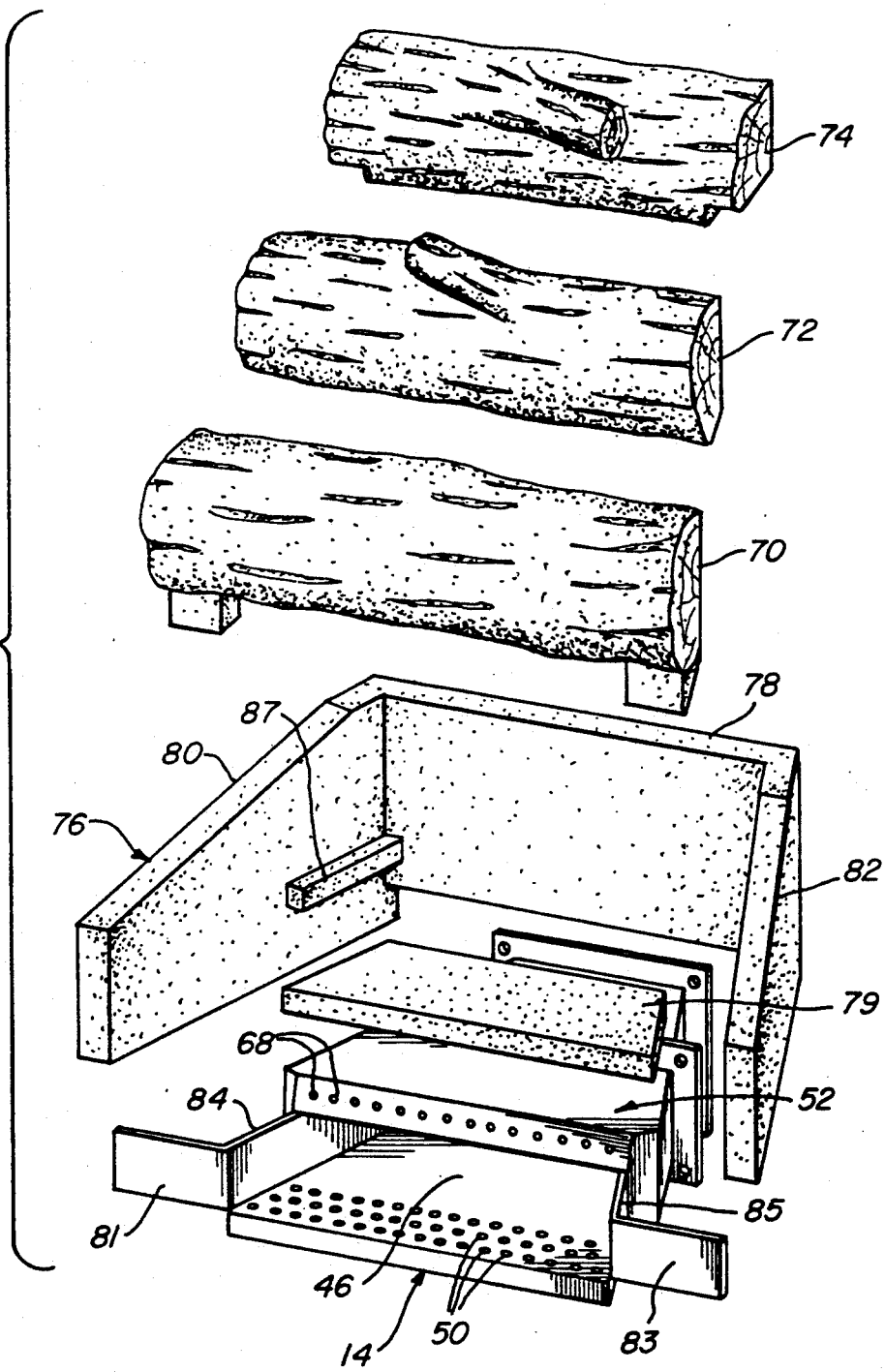
FIG. 7 is an exploded view of the pellet burner, log support member and artificial log set used in the pellet burning stove.
Figure 8:
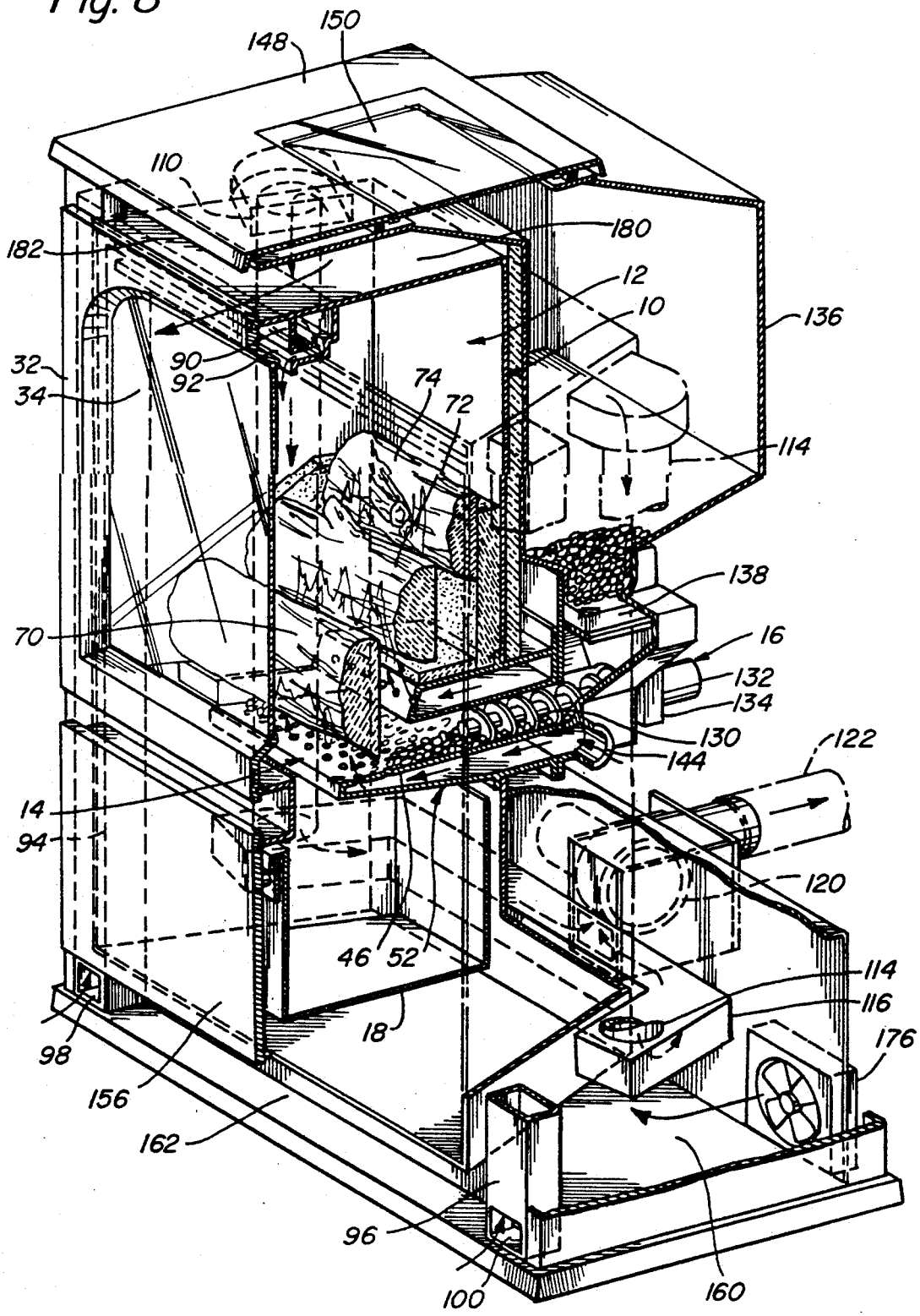
FIG. 8 is a perspective view of the pellet burning stove cut away to show the interior construction.

The pellet burning stove of the present invention also includes an artificial log set, including a front log 70, a middle log 72 and a back log 74, and a log support member 76. As best shown in FIG. 7, the support member 76 includes a rear wall 78 and side walls 80 and 82 extending forwardly from rear wall 78. A bottom piece 79 located on top plenum section 62 insulates top plenum section 62 and the pellets beneath it from the high temperature region. The logs 70, 72 and 74, the support member 76 and the bottom piece 79 are preferably fabricated of a low density refractory fiber material. The rear wall 78 of log support 76 rests on pellet burner 16, and the front portions of side walls 80 and 82 rest on projections 81 and 83, respectively, from pellet burner 14. Front log 70 rests on upstanding walls 84 and 85 on the sides of pellet burner 14. Middle log 72 rests on shelves 87 and 88 in side walls 80 and 82, respectively. Back log 74 rests on the tops of side walls 80 and 82.

Figure 2:
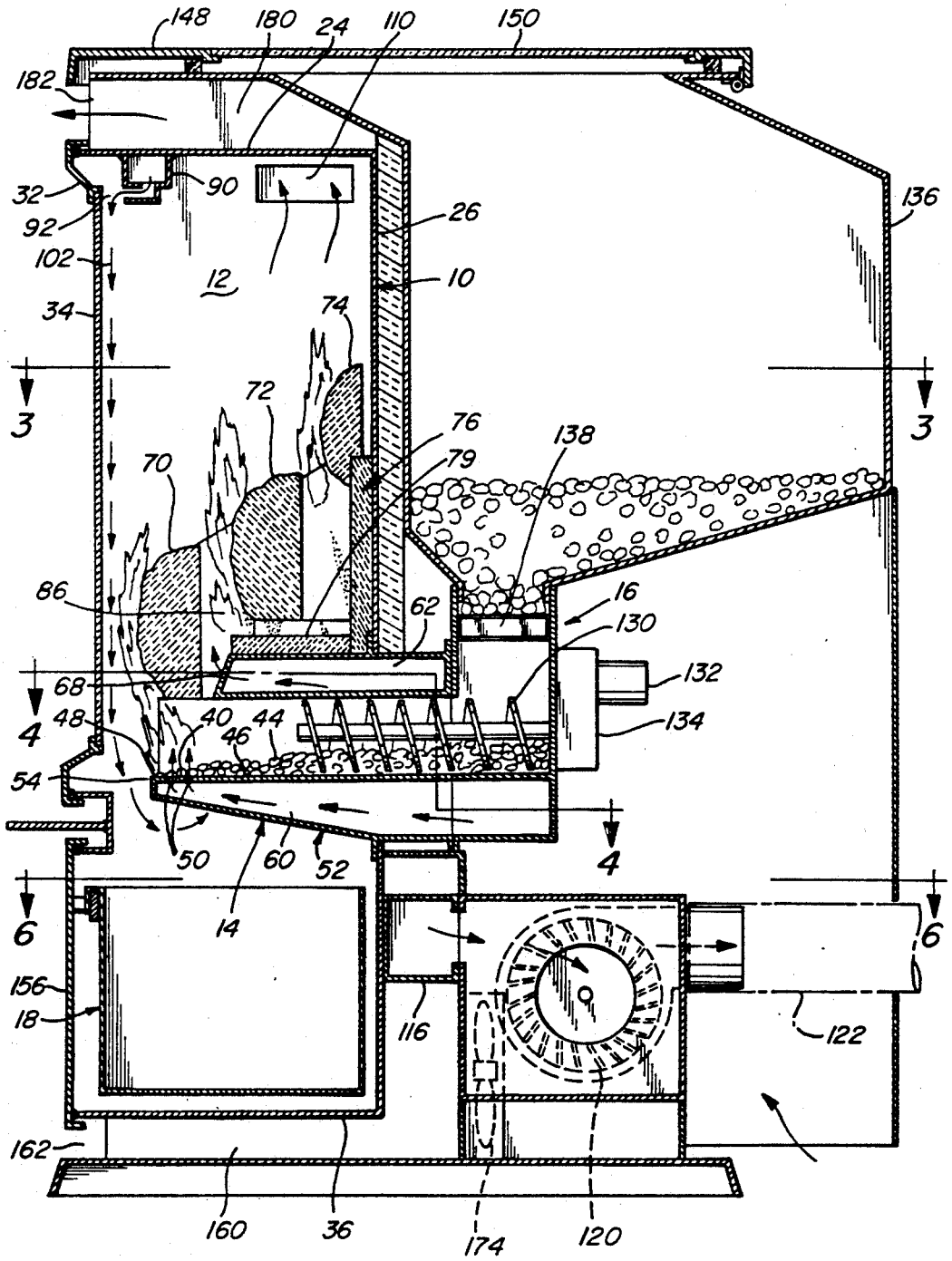
FIG. 2 is a cross-sectional side view of the pellet burning stove taken along the line 2—2 of FIG. 1.
Figure 3:
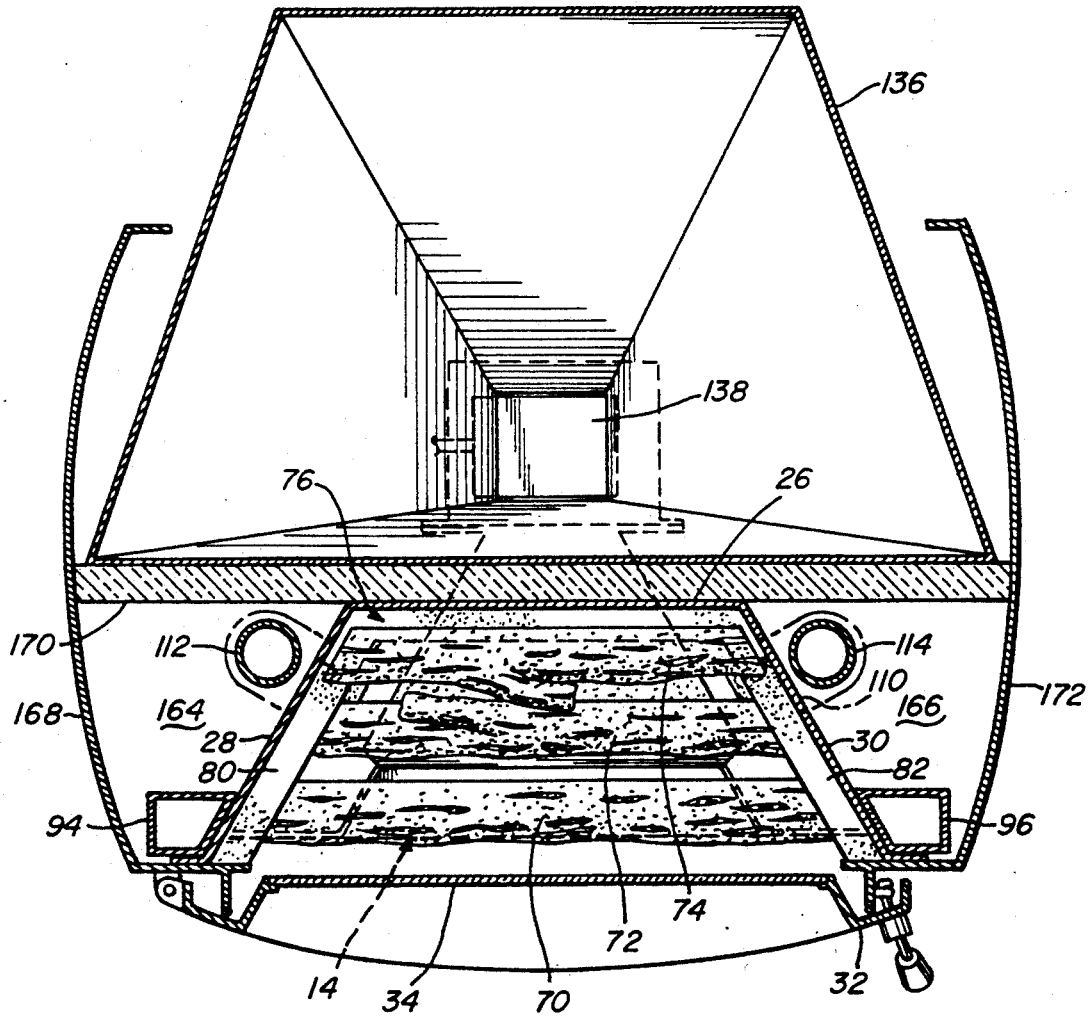
FIG. 3 is a cross-sectional top view of the pellet burning stove taken along the line 3—3 of FIG. 2.

As best shown in FIG. 2, the artificial logs 70 72, and 74 and the log support member 76 define a secondary combustion cavity 86 above the pellet burner 14. Combustion products from the burning of pellets in combustion zone 40 are directed into the cavity 86. In addition, secondary air flows through openings 68 in top plenum section 62 into the secondary combustion cavity 86 causing secondary combustion of the pellet combustion products. As discussed below, additional secondary air is provided by an air wash system which directs an air curtain downwardly across window 34. The surfaces of the refractory fiber logs and support member become very hot and reradiate into the cavity 86, causing a high temperature to be maintained therein and promoting secondary combustion. Flames are provided in front of and between the artificial logs, causing a realistic simulation of burning wood logs.

Additional combustion air is brought into the firebox 10 through an air wash system for transparent window 34. A manifold 90 having an exit slot 92 is mounted above window 34 such that exit slot 92 is parallel to window 34. Conduits 94 and 96 are connected to opposite ends of manifold 90 and extend downwardly along opposite sides of the stove front to openings 98 and 100, which are located at the bottom front of the stove. Air is drawn into conduits 94 and 96 through openings 98 and 100, respectively. The air drawn into manifold 90 is directed through exit slot 92 as an air curtain 102 across the inside surface of window 34. The air curtain 102 assists in maintaining the window 34 clean and free of deposits during operation. The air curtain 102 passes downwardly across window 34 to the region of pellet burner 14 and provides additional secondary air in the combustion zone 40 and in the cavity 86 for more complete combustion of the pellets. A glass cleaning system for a wood burning stove is disclosed in U.S. Pat. No. 4,683,868 issued Aug. 4, 1987 to Ferguson et al, which is hereby incorporated by reference.

Exhaust gases from combustion chamber 12 pass through exhaust openings 110 located near the upper rear of firebox side walls 28 and 30. The exhaust openings connect to exhaust conduits 112 and 114, which extend downwardly along the outside of firebox 10 to an exhaust manifold 116. Exhaust manifold 116 extends from exhaust conduits 112 and 114 around the rear of firebox 10 to an enclosed exhaust fan 120. The exhaust manifold 116 acts as a heat exchanger. Exhaust fan 120 forces exhaust gases from manifold 116 through a vent pipe 122 to the exterior of the home. An optional heat exchanger (not shown) can be connected in the exhaust gas path to more efficiently transfer heat to room air. The exhaust fan 120 is preferably a paddle type fan and maintains a flow of exhaust gas from the combustion chamber and also draws primary and secondary combustion air into the combustion chamber 12.

The feed system 16 for feeding pellets to pellet burner 14 includes a screw type auger 130 driven by a motor 132 through a gear reduction unit 134. An inlet end of auger 130 is positioned below a pellet bin 136, and an outlet end of auger 130 delivers pellets to pellet burner feed surface 46. A pusher block 138 at the base of pellet bin 136 meter pellets into auger 130. The pusher block 138 is a reciprocating block which pushes the pellets off a ledge so that they drop onto auger 130 and are transported to the pellet burner 14. The pusher block 138 isolates the auger from the pellet bin 136 and prevents migration of the fire to the pellet bin 136. The rate at which pellets are delivered to pellet burner 14 is determined by the rate at which pusher block 138 operates. Typical rates are in the range of about one pound per hour to about eight pounds per hour. The feed system 16 is connected to the rear of pellet burner 14 by an arrangement of mating flanges 140 and 142. The housing for auger 130 includes an air inlet 144 that delivers combustion air to air plenum 52 of pellet burner 14. The feed system, including the auger 130, motor 132, gear reduction unit 134 and pusher block 138, is preferably a Model Pelletmaster, manufactured by Harman Stove Company.

The pellet bin 136 is provided with a hinged cover 148 for loading of pellet bin 136. The cover 148 preferably includes a transparent window 150 which permits the level of pellets in bin 136 to be observed without opening cover 148. In addition, a gas shock absorber 152 is preferably connected between the main body of the stove and cover 148. The gas shock absorber 152 permits controlled opening and closing of cover 148 and permits cover 148 to remain in the open position for loading of pellet bin 136 without being held.

The ash pan 18 is preferably mounted to the rear of an ash pan door 156. The ash pan door 156 is hinged for movement about a vertical axis. When the ash pan door 156 is opened, the ash pan 18 swings out with it and is easily removed for ash disposal. In the closed position of the ash pan door 156, the ash pan 18 is located below pellet burner 14 and receives ashes from pellet burner 14. The use of an ash pan mounted to an ash pan door in a wood burning stove is disclosed in U.S. Pat. No. 4,858,536 issued Aug. 22, 1989 to Guest et al, which is hereby incorporated by reference.

The pellet burning stove of the present invention includes a system for the circulation of room air around firebox 10 to provide efficient transfer of heat to room air. An air chamber 160 located beneath firebox 10 has an opening 162 along the bottom front of the stove. Air chambers 164 and 166 are located on opposite sides of firebox 10. The air chamber 164 is defined by firebox side wall 28, a stove side wall 168 and a rear wall 170. Air chamber 166 is defined by firebox side wall 30, a stove side wall 172 and rear wall 170. The rear wall 170 includes an insulating panel to prevent excessive heating of the pellets in pellet bin 136. Optional fans 174 and 176 are mounted at the bottom of side wall 170 so as to direct room air into chambers 164 and 166, respectively. The circulation of room air around firebox 10 and any heat exchanger that may be utilized can occur by natural or forced convection. The air drawn into chambers 164 and 166 by forced or natural convection is heated by firebox 10. The air moves upwardly along the sides of firebox 10 to an air chamber 180 above firebox 10. The air is further heated in chamber 180 and then flows back into the room through an opening 182 in the front of the stove above window 34.

Figure 9:
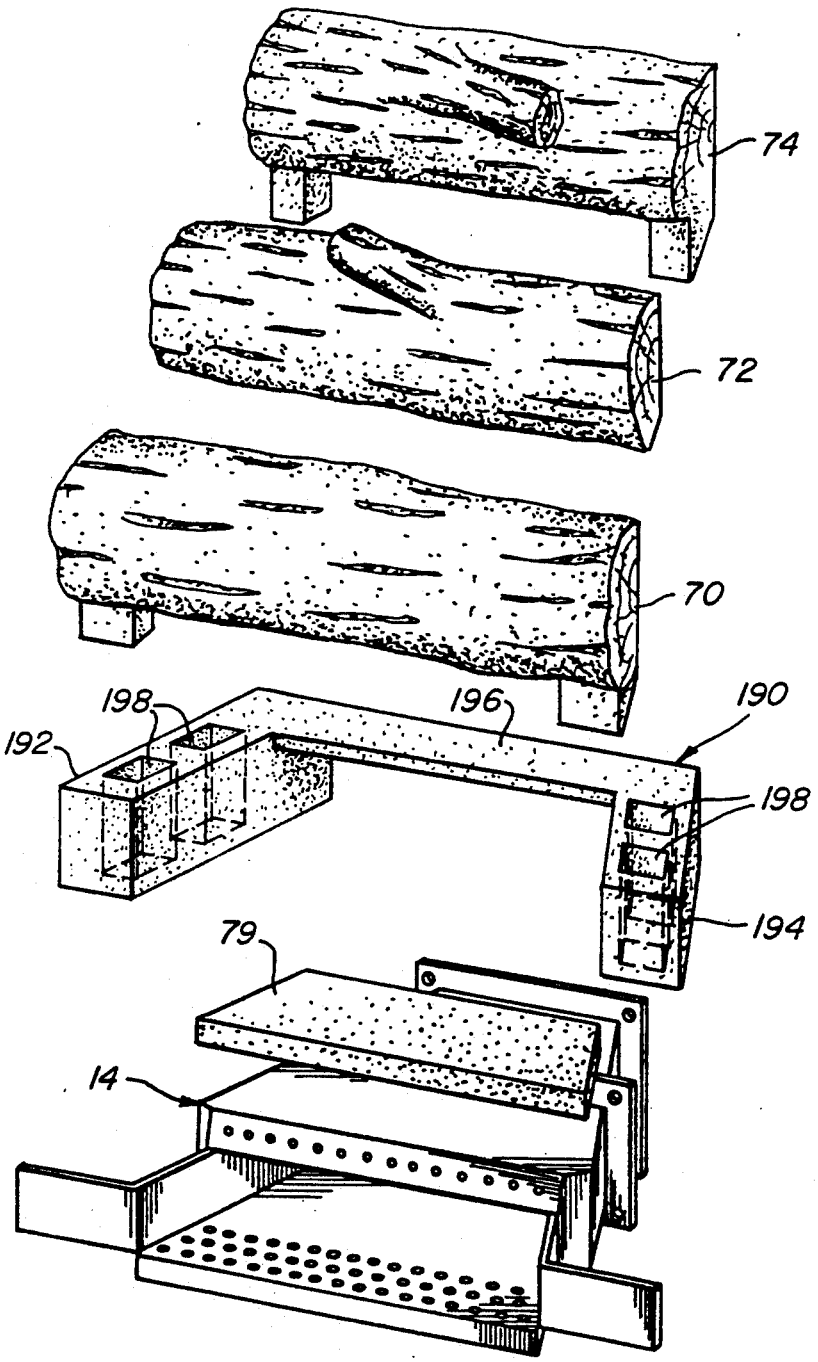
FIG. 9 is an exploded view of an alternate embodiment of the pellet burner, log support member and artificial log set.

An alternate embodiment of the log support member is shown in FIG. 9. The pellet burner 14, artificial logs 70, 72 and 74 and bottom piece 79 can be the same as shown and described hereinabove. A log support member 190 includes side walls 192 and 194 interconnected by and extending forwardly from a rear strip 196. The rear strip 196 has a relatively small vertical dimension. The side walls 192 and 194 are relatively thick and have vertical passages 198 extending therethrough. The vertical passages 198 permit the flow of secondary combustion air into the region of the artificial logs 70, 72 and 74 and the secondary combustion cavity 86 for enhancing the complete combustion of the pellets and their combustion byproducts.

While there have been shown and described what are at present considered the preferred embodiments of the present invention, it will be obvious to those skilled in the art that various changes and modifications may be made therein without departing from the scope of the invention as defined by the appended claims.

We claim:

1. A pellet burner stove comprising:

a firebox defining a combustion chamber;

a pellet burner located within said firebox, said pellet burner comprising a burner surface having an elongated combustion zone defined by a plurality of primary air openings in said burner surface, and a feed surface adjacent to said combustion zone;

feed means for moving a layer of combustible pellets across said feed surface into said combustion zone and for moving ashes from said combustion zone;

means for supplying combustion air upwardly through said primary air openings and said layer of combustible pellets;

an ash pan for receiving ashes from said pellet burner;

an artificial log set and a log support member for supporting said artificial log set, said artificial log set and said log support member defining a secondary combustion cavity; and means for supplying secondary air to said secondary combustion cavity, said secondary combustion cavity receiving combustion products from said combustion zone.

2. A pellet burning stove as defined in claim 1 wherein said plurality of primarily air openings in said burner surface comprises one or more rows of air openings perpendicular to a direction of movement of said combustible pellets.

3. A pellet burning stove as defined in claim 2 wherein said pellet burner includes a conduit defining an air passage below said burner surface for supplying air to said primary air openings.

4. A pellet burning stove as defined in claim 2 wherein said combustion zone and said feed surface are generally flat and coplanar.

5. A pellet burning stove as defined in claim 1 wherein said pellet burner includes means defining a combustion air plenum surrounding at least a portion of said feed surface and connected to said primary air openings.

6. A pellet burning stove as defined in claim 5 wherein said combustion air plenum includes a plurality of secondary air openings above said burner surface for supplying secondary air above said combustion zone.

7. A pellet burning stove as defined in claim 1 wherein said feed surface is located between said combustion zone and said feed means and is tapered from relatively narrow adjacent to said feed means to relatively wide adjacent to said combustion zone such that combustible pellets supplied by said feed means are distributed across said combustion zone.

8. A pellet burning stove as defined in claim 1 wherein said burner surface has an edge located above said ash pan and wherein said feed means pushes ashes over the edge of said burner surface into said ash pan.

9. A pellet burning stove as defined in claim 1 wherein said burner surface and said feed means are configured to provide generally horizontal movement of said combustible pellets.

10. A pellet burning stove as defined in claim 1 wherein said feed means comprises a rotating auger for supplying pellets to said feed surface, a pellet bin for containing a supply of combustible pellets and a pusher block for moving pellets from said bin to said auger.

11. A pellet burning stove as defined in claim 1 wherein said artificial log set and said log support member are fabricated of a low density refractory fiber material.

12. A pellet burning stove as defined in claim 1 wherein said firebox includes a transparent window and means for supplying a curtain of air downwardly across an inner surface of said transparent window, said curtain of air after passing over said transparent window providing secondary combustion air to said combustion zone.

13. A pellet burning stove as defined in claim 8 wherein said firebox includes a hinged ash pan door that is movable between an ash collection position and an open position and wherein said ash pan is mounted to said ash pan door so as to be easily removable therefrom.

14. A pellet burning stove as defined in claim 10 wherein said feed means further includes a transparent cover on said pellet bin.

15. A pellet burning stove as defined in claim 10 wherein said feed means further includes a hinged cover on said pellet bin and a shock absorber connected between said hinged cover and said pellet bin for controlled opening and closing of said cover.

16. A pellet burner comprising:

a burner surface including a combustion zone defined by at least one row of primary air openings in said burner surface, and a feed surface adjacent to said combustion zone;

feed means for moving a layer of combustible pellets across said feed surface and through said combustion zone;

means for supplying combustion air upwardly through said primary air openings and said layer of combustible pellets; and means defining a combustion air plenum surrounding a major portion of said feed surface and connected to said primary air openings.

17. A pellet burner as defined in claim 16 wherein said combustion zone and said feed surface are generally flat and coplanar.

18. A pellet burner as defined in claim 17 wherein said combustion air plenum includes a plurality of secondary air openings above said burner surface for supplying secondary air above said combustion zone.

19. A pellet burner as defined in claim 16 wherein said feed surface is located between said combustion zone and said feed means and is tapered from relatively narrow adjacent to said feed means to relatively wide adjacent to said combustion zone such that combustible pellets supplied by said feed means are distributed across said combustion zone.

20. A pellet burner as defined in claim 16 wherein said burner surface and said feed means are configured to provide generally horizontal movement of said combustible pellets.

21. A pellet burner stove comprising:

a firebox defining a combustion chamber;

a pellet burner located within said firebox, said pellet burner comprising a burner surface having a combustion zone defined by a plurality of primary air openings in said burner surface, and a feed surface adjacent to said combustion zone;

feed means for moving combustible pellets across said feed surface into said combustion zone, said feed surface causing the pellets supplied by said feed means to spread into a thin layer as they approach said combustion zone;

means for maintaining said pellets at a low temperature relative to said combustion camber until they reach said combustion zone comprising an air plenum surrounding a major portion of said feed surface;

means for supplying combustion air upwardly through said primary air openings and said layer of combustible pellets; and means for receiving ashes from said pellet burner.

22. A pellet burning stove as defined in claim 21 wherein said feed surface is located between said combustion zone and said feed means and is tapered from relatively narrow adjacent to said feed means to relatively wide adjacent to said combustion zone such that combustible pellets supplied by said feed means are distributed across said combustion zone.

23. A pellet burning stove as defined in claim 21 further including an artificial log set and a log support member for supporting said artificial log set, said artificial log set and said log support member defining a secondary combustion cavity, said stove further including means for supplying secondary air to said secondary combustion cavity, said secondary combustion cavity receiving combustion products from said combustion zone.

24. A pellet burning stove as defined in claim 21 wherein said plurality of primarily air openings in said burner surface comprises one or more rows of air openings perpendicular to a direction of movement of said combustible pellets and adjacent to an edge of said burner surface.

* * * * *